US007520905B1

(12) United States Patent
Lightner

(10) Patent No.: US 7,520,905 B1
(45) Date of Patent: Apr. 21, 2009

(54) ADDITIVES DERIVED FROM BIOMASS EXTRACTED BY BIODIESEL FUEL OIL

(76) Inventor: Gene E Lightner, 706 SW. 296th, Federal Way, WA (US) 98023

( * ) Notice: Subject to any disclaimer, the term of this patent is extended or adjusted under 35 U.S.C. 154(b) by 679 days.

(21) Appl. No.: 11/348,605

(22) Filed: Feb. 6, 2006

(51) Int. Cl.
*C10L 1/188* (2006.01)
*C10L 1/185* (2006.01)

(52) U.S. Cl. ..... 44/388; 44/307; 44/308; 44/350; 44/385; 44/386; 44/402; 549/489; 562/515; 562/577

(58) Field of Classification Search ..... 44/307, 44/308, 350, 385, 386, 388, 402; 549/489; 562/515, 577
See application file for complete search history.

(56) References Cited

U.S. PATENT DOCUMENTS 5,608,105 A 3/1997 Fitzpatrick ..... 562/515
5,859,263 A 1/1999 Ghorpade et al. ..... 549/326
6,054,611 A 4/2000 Farone et al. ..... 562/515
6,409,778 B1 6/2002 Auschra et al. ..... 44/388
6,518,440 B2 * 2/2003 Lightner ..... 549/497
7,351,268 B2 * 4/2008 Rae et al. ..... 44/388

* cited by examiner

*Primary Examiner*—Bernard Dentz

(57) ABSTRACT

Aqueous sulfuric acid is used for hydrolysis of a biomass, constituting a hydrolysate, to produce organic compounds. Organic compounds such as furfural and hyroxymethylfurfural are formed within the hydrolysate. Heterocyclic ring opening within hyroxymethylfurfural forms levulinic acid within the hydrolysate. Furfural and levulinic acid are extracted by a biodiesel fuel oil to increase content of biodiesel fuel oil. Biodiesel fuel oil generally consists of vegetable oils, insoluble in aqueous sulfuric acid, and affords access to, extraction of furfural and levulinic acid. Extracted hydrolysate is recycled for further hydrolysis of biomass.

10 Claims, 2 Drawing Sheets

ADDITIVES DERIVED FROM BIOMASS EXTRACTED BY BIODIESEL FUEL OIL

BACKGROUND OF THE INVENTION

By hydrolysis of biomass, sugars are obtained within a hydrolysate. This operation is continued to produces dehydrated sugars, such as furfural and hyroxymethylfurfural, (HMH). Sulfuric acid serves as a catalyst for HMF heterocyclic ring opening to form levulinic acid, resulting in a hydrolysate containing furfural and levulinic acid. Furthermore furfural and levulinic acid are extracted from the hydrolysate by biodiesel fuel oil to establish biodiesel fuel of increased content. The extracted hydrolysate is recycled for further hydrolysis of biomass. Recovery of sulfuric acid is desirous so as to achieve a cost effective hydrolysis operation.

A state of the art method for production of levulinic acid from carbohydrate-containing material is disclosed in U.S. Pat. No. 5,608,105, wherein two reactors are specified.

A related state of the art within U.S. Pat. No. 6,054,611 specifies two temperatures for hydrolysis of a biomass to generate sugars for reaction for production of levulinic acid following hydrolysis. Also taught, is employment of chromatography techniques for separating products of hydrolysis. Desirous recycle of sulfuric acid is a feature noticeable absent form these teachings.

Additives added to biodiesel oils is the topic of U.S. Pat. No. 6,408,778, in which chemicals for addition to biodiesel oil is mentioned. Specification of chemicals derived from biomass is a feature noticeable absent within this patent.

Overall, the prior art is devoid of extraction features embodied within the present invention.

Accordingly, it is believed that, an acceptable inexpensive method to increase content of biodiesel fuel is lacking The present concern is producing biodiesel fuel of increased content from biomass.

A primary object of this invention is hydrolysis of a biomass to form furfural and HMF. In addition heterocyclic ring opening of HMF, catalyzed by sulfuric acid, forms levulinic acid.

A basic object of this invention is to extract furfural and levulinic acid by biodiesel oil.

An additional object of this invention is recycling extracted sulfuric acid.

With the above and other objects in view, this invention relates to the novel features and alternatives and combinations presently described in the brief description of the invention.

GENERAL FEATURES OF THE METHOD

Sulfuric acid, utilized for hydrolysis of a biomass, creates pentoses and hexoses within a hydrolysate. Subsequent dehydration of these sugars forms furfural and hydrometylfurfural (HMF). Molecular weight of HMF=126 according to the book Organic Chemistry by Hill and Kelley. This teaching, in addition, accounts for 2 molecules of water at 18, removed by dehydration to become a molecular weight of 162. Sulfuric acid, within the hydrolysate, serves as a catalyst for heterocyclic ring opening of HMF to form levulinic acid and formic acid. Formic acid is unstable and decomposes within hot sulfuric acid to yield water and carbon monoxide. Formic acid of molecular weight of 46 and levulinic acid of molecular weight of 116 for a total of 162 or about 72% of total organic acid. Resulting levulinic acid is extracted by biodiesel fuel oil insoluble in sulfuric acid, soluble in extracted furfural and levulinic acid. Biodiesel fuel oil containing extracted levulinic acid and furfural becomes biodiesel fuel. Biodiesel oil is ordinarily selected from the group consisting of soybean oil and canola oil including an individual or a combination thereof. Biodiesel oil is often a mixture.

Thus sugar components of a biomass are dehydrated to extend content of biodiesel fuel. Biomass is often selected from the group consisting of wood, cornstalks, bagasse and straw including an individual or a combination.

Extracted hydrolysate is subjected to recycle for additional hydrolysis of a biomass. Prior to recycle, extracted hydrolysate has water removed so as to restore to original concentration. This operation is often performed by a water permeable membrane.

DESCRIPTION OF THE PREFERRED EMBODIMENT

The present invention, in its broadest aspect, is distinguished by a method to increase biodiesel oil content by additives derived from a biomass.

What is claimed comprises: providing a biomass, aqueous sulfuric acid, and biodiesel oil. By combining biomass with sulfuric acid, hydrolysis, transpires to form sugars within a hydrolysate. Upon formation of sugars and subjecting sugars to dehydration, furfural and hydroxymethylfurfural are formed. Hydromethylfurfural is subjected to splitting heterocyclic rings within hydroxymethylfurfural to form levulinic acid. Levulinic acid and furfural, within hydrolysate, are subject to extracting by biodiesel oil. Recycling hydrolysate resulting from extraction of levulinic acid and furfural for hydrolysis of additional biomass. Thereby biodiesel oil content is increased by additives derived from a biomass.

Key features of this invention are:

Sugars are derived from a biomass acidic hydrolysis.

Sugars are subject to dehydration to form furfural and hydroxymethylfurfural.

Hydroxymethylfurfural, containing heterocyclic rings, is split to form levulinic acid.

Biodiesel oil is insoluble in aqueous sulfuric acid

Vevulinic acid and furfural, within hydrolysate, is extracted by biodiesel oil.

Extracted hydrolysate is recycled.

Recycled hydrolysate contains glucose.

Prior to recycle, extracted hydrolysate has water removed and is restored to original concentration.

The method is often operated in continuous fashion.

BRIEF DESCRIPTION OF THE DRAWINGS

The features that are considered characteristic of this invention are set forth in claim 1 and the appended claims. This invention, however, both as to its origination and method of operations as well as additional advantages will best be understood from the following description when read in conjunction with the accompanying drawings in which:

DETAILED DESCRIPTION OF THE PREFERRED EMBODIMENT

Figure 1:
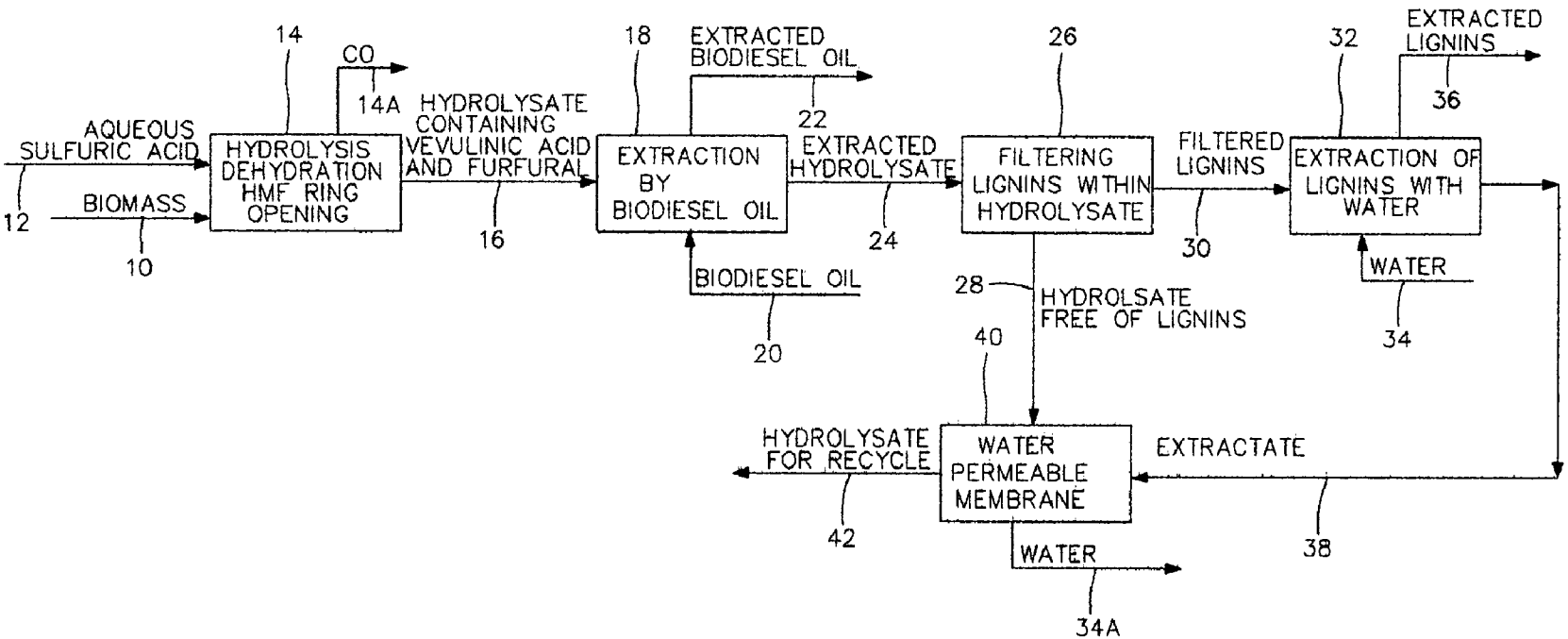
FIG. 1 is a flow sheet denoting the invention as set forth in claim 1 and the appended claims.

The flow diagram of FIG. 1 illustrates the preferred embodiment of the present invention, as claimed within claim 1. In the preferred embodiment of the present invention, the features that are considered characteristic of this invention are set forth in claim 1 and the appended claims. In the drawing, rectangles represent stages or functions of the present invention and not necessarily separate components. Arrows indicate direction of flow in the method. This invention, however, both as to its origination and method of operations as well as additional advantages will best be understood from the following description when read in conjunction with the accompanying drawings in which:

Referring to FIG. 1, biomass 10 and aqueous sulfuric acid 12, are conveyed to hydrolysis, dehydration and HMF ring opening stage 14, where rearrangement forms levulinic acid and formic acid, with is unstable and decomposes to form CO 14A within hydrolysate containing levulinic acid and furfural 16 which is transferred to extraction by biodiesel oil stage 18 and extracted by biodiesel oil 20 to create extracted biodiesel oil 22 and extracted hydrolysate 24. Extracted hydrolysate, containing suspended lignins, 24 is submitted to filtering lignins within hydrolysate stage 26 to produce filtered lignins 30 and hydrolysate free of lignins 28. Filtered lignins 30 are conducted to extraction of lignins with water stage 32 to be extracted by water 34 to produce extracted lignins 36 and extractate 38. Extractate 38 and hydrolysate free of lignins 28 are combined and transferred to water permeable membrane stage 40 where water 34A is removed from the combination to produce hydrolysate for recycle 42.

HMF ring opening stage 14 contribute levulinic acid and formic acid from ring splitting of heterocyclic rings within HMF. Formic acid, thus formed, is unstable and decomposes within hot sulfuric acid to yield water and carbon monoxide. Water permeable membrane stage 40 permeates water and rejects sulfuric acid to provide hydrolysate for recycle 42. Aqueous sulfuric acid 12, is employed to initiate hydrolysis, and is replaced by hydrolysate for recycle 42 for further hydrolysis of biomass. Biodiesel oil 20, as a vegetable oil, is insoluble in aqueous sulfuric acid.

Figure 2:
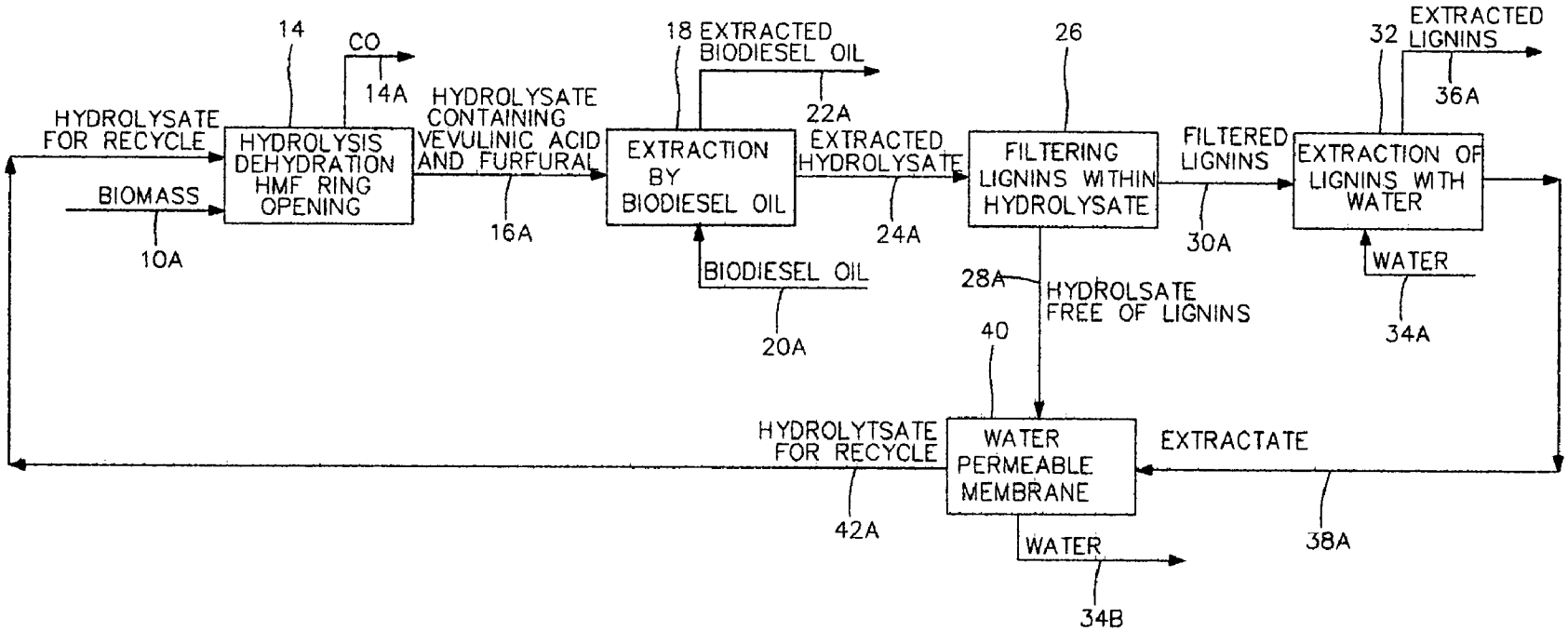
FIG. 2 is a flow sheet denoting the invention as set forth in the appended claims.

Referring to FIG. 2, biomass 10A and hydrolysate for recycle 42A, are conveyed to hydrolysis, dehydration and HMF ring opening stage 14, where rearrangement forms levulinic acid and formic acid, with is unstable and decomposes to form CO 14A within hydrolysate containing levulinic acid and furfural 16 which is transferred to extraction by biodiesel oil stage 18 and extracted by biodiesel oil 20 to create extracted biodiesel oil 22A from biodiesel oil 20A and extracted hydrolysate 24A. Extracted hydrolysate, containing suspended lignins, 24A is submitted to filtering lignins within hydrolysate stage 26 to produce filtered lignins 30A and hydrolysate free of lignins 28A. Filtered lignins 30A are conveyed to extraction of lignins with water stage 32 to be extracted by water 34A to produce extracted lignins 36A and extractate 38A. Extractate 38A and hydrolysate free of lignins 28A are combined and transferred within water permeable membrane stage 40 where water 34B is separated from the combination to produce hydrolysate for recycle 42A.

What is claimed is:

1. A method to increase biodiesel oil content with additives derived from a biomass, which comprises:

Providing biomass, and providing aqueous sulfuric acid, and providing biodiesel oil, and combining said biomass with said sulfuric acid for hydrolysis to form sugars within a hydrolysate, and subjecting sugars to dehydration to form furfural and hydroxymethylfurfural, and splitting the heterocyclic ring within said hydroxymethylfurfural to form levulinic acid, and extracting said furfural and said levulinic acid from said hydrolysate by said biodiesel oil, and recycling hydrolysate resulting from extraction of levulinic acid and furfural for hydrolysis of additional biomass, thereby biodiesel oil content is increased by additives derived from a biomass.

2. The method of claim 1 wherein said biodiesel oil is selected from the group consisting of soybean oil and canola oil including an individual or a combination thereof.

3. The method of claim 1 wherein said biodiesel oil is a mixture.

4. The method of claim 1 wherein said wherein said sulfuric acid forms a hydrolysate.

5. The method of claim 4 wherein said wherein said hydrolysate contains lignins.

6. The method of claim 5 wherein said lignins are filtered from said hydrolysate.

7. The method of claim 1 wherein recycled hydrolysate, prior to recycle, is restored to original concentration by a water permeable membrane.

8. The method of claim 5 wherein recycled hydrolysate contains glucose.

9. The method of claim 1 wherein said biodiesel oil is insoluble in aqueous sulfuric acid.

10. The method of claim 1 wherein said biomass is selected from the group consisting of wood, cornstalks, bagasse and straw including an individual or a combination.

* * * * *